US006387611B2

(12) United States Patent
Lelental et al.

(10) Patent No.: US 6,387,611 B2
(45) Date of Patent: May 14, 2002

(54) PHOSPHORIC ACID ESTER SURFACE MODIFIERS FOR SILVER CARBOXYLATE NANOPARTICLES

(75) Inventors: Mark Lelental, Rochester; David A. Dickinson; James L. Wakley, both of Brockport; Michael W. Orem; Peter J. Ghyzel, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/764,665

(22) Filed: Jan. 18, 2001

Related U.S. Application Data

(63) Continuation-in-part of application No. 09/501,815, filed on Feb. 10, 2000, now abandoned.

(51) Int. Cl.[7] ..... G03C 1/498; G03C 1/00

(52) U.S. Cl. ..... 430/620; 430/529; 430/610; 430/617; 430/619; 430/631; 252/583; 252/600

(58) Field of Search ..... 430/620, 617, 430/610, 619, 631, 529; 252/583, 600, 389.24, 400.24

(56) References Cited

U.S. PATENT DOCUMENTS 3,666,477 A 5/1972 Goffe
3,887,597 A 6/1975 Ohkubo et al.
5,496,696 A * 3/1996 Patel et al. ..... 430/619

FOREIGN PATENT DOCUMENTS

EP 0 848 286 A1 6/1998

* cited by examiner

*Primary Examiner*—Thorl Chea
(74) *Attorney, Agent, or Firm*—J. Jeffrey Hawley

(57) ABSTRACT

There is disclosed an oxidation-reduction imaging forming composition comprising an aqueous based dispersion of (i) nanoparticulate silver carboxylate particles having on the surface of the particles a surface modifier which is a phosphoric acid ester and (ii) an organic reducing agent. In particular, the surface modifiers can be mixtures of mono- and di-esters of orthophosphoric acid and hydroxyl-terminated, oxyethylated long-chain alcohols or oxyethylated alkyl phenols or derivatives thereof. Also disclosed are various compositions including the dispersions including oxidation-reduction imaging forming compositions, thermographic elements and photothermographic compositions and elements. The preferred carboxylate is a silver salt of a long chain fatty acid such as silver behenate. A media milling method and a controlled precipitation method of making the dispersions are also disclosed

24 Claims, 1 Drawing Sheet

PHOSPHORIC ACID ESTER SURFACE MODIFIERS FOR SILVER CARBOXYLATE NANOPARTICLES

CROSS REFERENCE TO RELATED APPLICATIONS

This is a continuation-in-part of application Ser. No. 09/501,815, filed Feb. 10, 2000, now abandoned and entitled "PHOSPHORIC ACID ESTER SURFACE MODIFIERS FOR SILVER CARBOXYLATE NANOPARTICLES" by Lelental et al.

FIELD OF THE INVENTION

This invention relates to the use phosphoric acid esters, in particular mixtures of mono- and di-esters of orthophosphoric acid and hydroxyl-terminated, oxyethylated long-chain alcohols or oxyethylated alkyl phenols or derivatives thereof, as surface modifiers for water insoluble silver carboxylate nanoparticles. The nanoparticles are used in aqueous oxidation-reduction imaging forming compositions that include the nanoparticles and a reducing agent. The carboxylates are typically silver salts of long chain fatty acids that are used to formulate imaging forming compositions that are useful in aqueous photothermographic or thermographic imaging elements.

DESCRIPTION RELATIVE TO THE PRIOR ART

Photothermographic materials are well known in the photographic art. Photothermographic materials are also known as heat developable photographic materials. The photothermographic materials, after imagewise exposure, are heated to moderately elevated temperatures to produce a developed image in the absence of separate processing solutions or baths. The heat development can provide a developed silver image in the photothermographic material.

Thermographic materials are similar except that there is no photosensitive material present. Images are formed by direct imagewise heating.

An example of a known photothermographic silver halide material comprises (a) a hydrophilic photosensitive silver halide emulsion containing a peptizer with (b) an organic solvent mixture, (c) a hydrophobic binder and (d) an oxidation-reduction image-forming composition. The oxidation-reduction imaging forming composition typically comprises (i) a silver carboxylate that is usually a silver salt of a long-chain fatty acid, such as silver behenate or silver stearate, in combination with (ii) an organic reducing agent, such as a phenolic reducing agent. It has been desirable to have hydrophilic photosensitive silver halide emulsion containing a peptizer in such a photothermographic material because of the higher photosensitivity of the silver halide emulsion and the ease of control in preparation of the emulsion based on conventional aqueous silver halide emulsion technology.

A problem has been encountered in preparing these photothermographic silver halide materials. This problem involves the mixing of a hydrophilic photosensitive silver halide emulsion containing a peptizer with an oxidation-reduction imaging forming composition. The imaging forming composition contains hydrophobic components including a hydrophobic binder, such as poly(vinyl butyral), and a silver salt of a long-chain fatty acid, such as a silver salt of behenic acid. Typically, when the hydrophilic photosensitive silver halide emulsion is mixed with the hydrophobic imaging forming materials and then coated on a suitable support to produce a photothermographic element, the resulting element produces a less than desired degree of photosensitivity, contrast and maximum density upon exposure and heat processing. This problem has been encountered in photothermographic silver halide materials, as described in, for example, U.S. Pat. No. 3,666,477 of Goffe, issued May 30, 1972. Goffe proposed addition of alkylene oxide polymers and a mercaptotetrazole derivative to the photothermographic material to help provide increased photosensitivity.

In addition, a variety of organic solvents have been proposed in order to help prepare a photothermographic silver halide composition containing the described image-forming components. The organic solvents that have been proposed include isopropanol, acetone, toluene, methanol, 2-methoxyethanol, chlorinated solvents, acetone-toluene mixtures and certain non-aqueous polar organic solvents. The described individual solvents, such as isopropanol, have not provided the desired improved properties. There has been a continuing need to provide improved relative speed and contrast with desired maximum image density.

Agfa EPA 0 848 286 published Jun. 17, 1998, discloses a thermosensitive element comprising silver behenate, an organic reducing agent therefor in thermal working relationship therewith and a binder, characterized in that the silver behenate is not associated with mercury and/or lead ions. While a surfactant is used during the preparation of the silver behenate, large crystals result.

U.S. Pat. No. 3,887,597 issued Jun. 3, 1975 to Ohkubo et al describes the preparation of a silver salt of an organic acid in the presence of a phosphoric ester solvent. However, the phosphoric ester is not water-soluble and serves as a solvent for the organic acid before precipitation. Also, before use and before admixture with other components, the phosphoric ester solvent is removed and the silver salt of an organic acid is isolated. (Col 5 lines 52 through 59) After isolation and washing, the salt is incorporated into an organic coating solution along with other components. See for example the coating composition of Example 4 using isopropyl alcohol—methanol—acetone—methyl cellosolve.

As noted in the discussion of the '597 patent above, traditional photothermographic elements have been coated from organic solvents. It would be highly desirable to be able to produce an aqueous based element.

SUMMARY OF THE INVENTION

In one aspect of the invention, there is provided an oxidation-reduction imaging forming composition comprising an aqueous based dispersion of (i) nanoparticulate silver carboxylate particles having on the surface of the particles a surface modifier which is a phosphoric acid ester and (ii) an organic reducing agent.

In another aspect of the invention, there is provided a photothermographic composition comprising an aqueous based dispersion of a) a photosensitive silver halide emulsion containing a peptizer and b) an oxidation-reduction imaging forming composition comprising (i) nanoparticulate silver carboxylate particles having on the surface of the particles a surface modifier which is a phosphoric acid ester and (ii) an organic reducing agent. The described aqueous photothermographic composition can be coated on a support to provide a useful photothermographic element.

DETAILED DESCRIPTION OF THE INVENTION

Figure 1:
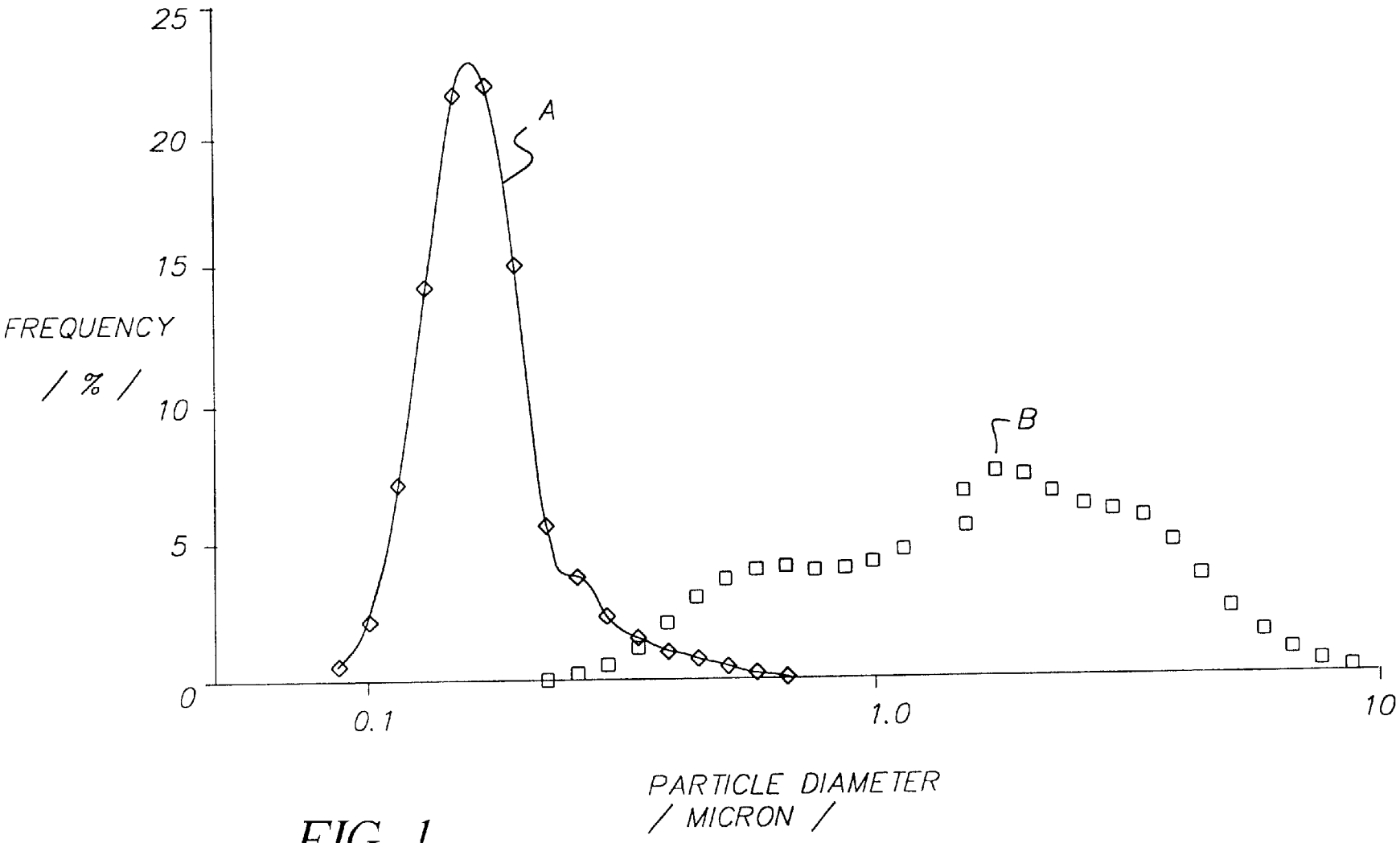
FIG. 1 is a particle diameter-frequency plot for a composition of the invention compared to a comparative composition.

This invention solves, or greatly minimizes, the prior art problems referred to above. A composition is provided that is an aqueous based coating composition rather than an organic solvent based coating composition. The aqueous coating composition comprises at least an organic reducing agent and a silver carboxylate dispersion containing smaller particles and narrower particle size distributions than provided in prior art coating compositions. The silver carboxylate particles exhibit greatly improved properties. It was particularly surprising that such fine particles could be prepared significantly free of contamination and that they could be coated from an entirely aqueous coating composition. In photothermographic applications, images produced from these dispersions exhibit a high degree of image transparency, and improved physical characteristics. The nanoparticulate, aqueous, silver carboxylate dispersions are easy to filter and display excellent shelf life. These dispersions have been successfully incorporated with the other necessary ingredients into an aqueous photothermographic imaging element and successfully exposed and thermally processed using a laser printer and thermal processor. The aqueous based compositions can be coated from aqueous systems thereby avoiding the problems and expense associated with organic solvent recovery.

The materials of this invention offer several advantages over the materials using common dispersants, in addition to providing for aqueous coating. The advantages arise from the effect of the surface modifiers on the particle size and its distribution, colloidal stability and physical properties of the dispersion. Many of the commonly used dispersing aids/stabilizers often cause adverse photographic effects, in particular fog, losses of photographic speed, contrast, maximum density, and poor keeping characteristics. The phosphoric acid ester derivatives used in this invention offer the advantage that they do not show these adverse photographic effects.

In the case of attrition milling of metal salts or complexes such as water insoluble silver salts of carboxylic acids, the surface modifiers used in this invention offer higher degree of particle size reduction, an improved colloidal stability of the dispersed system, higher chemical reactivity and lower low-shear viscosity. The smaller silver carboxylate, e.g. silver behenate, particle size increases the reactivity of the silver metal-forming oxidation-reduction photothermographic development chemistry and hence, a lower temperature and (or) shorter development time is required to generate final silver image. Furthermore, the use of a nanoparticulate film microstructure provides for a significant reduction of the film turbidity generally attributed to the particle size controlled light scattering.

The present invention relates to aqueous nanoparticulate dispersions of a silver carboxylate and an organic reducing agent. Particularly preferred carboxylates are silver salts of long chain fatty acids such, for example, silver stearate, silver behenate, silver caprate, silver hydroxystearate, silver myristate and silver palmitate.

The surface modifier in the present invention is a phosphoric acid ester. More particularly, useful phosphoric acid esters include mixtures of mono- and di-esters of orthophosphoric acid and hydroxyl-terminated, oxyethylated long-chain alcohols or oxyethylated alkyl phenols, as represented by the general structure:

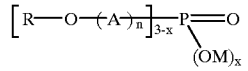

where $x = 1$ or 2;

where R is either an alkyl group, straight chain or branched chain, with between 8 and 16 carbon atoms, or an alkyl phenyl group with between 12 and 16 carbon atoms, the alkyl group being in the para position relative to the oxygen atom, O. A is an ethylene oxide group ($—CH_2CH_2O—$), or a propylene oxide group, or a mixture of both groups, and n has average values of between 3 and 12. M is either hydrogen (the acid form) or an alkali metal cation such as sodium (the base-neutralized form). These compounds are available in a number of structural variations from several manufacturers under the trade names such as Emphos™, Rhodafac™, T-Mulz™, Tryfac™, and Servoxyl™.

Aqueous based nanoparticulate silver carboxylate dispersions can be made by a media milling process comprising the steps of:

(A) providing a silver carboxylate dispersion containing a silver carboxylate, water as a carrier for the carboxylate and a surface modifier as described;

(B) mixing the carboxylate dispersion with rigid milling media having an average particle size less than 500 micrometers;

(C) introducing the mixture of step (B) into a high speed mill;

(D) milling the mixture from step (C) until a carboxylate particle size distribution is obtained wherein 90% by weight of the carboxylate particles have a size less than 1 micrometer; and (E) separating the milling media from the mixture milled in step (D).

By "nanoparticulate dispersion of silver carboxylate particles", we mean that the silver carboxylate dispersions have an effective average particle size of less 1000 nm. In preferred embodiments, the effective average particle size is less than 200 nm. Using polymeric milling media having an average particle size of less than 500 micrometers, preferably about 100 micrometers, 90% by weight of the carboxylates can be milled to a particle size of less than 350 nanometers (nm). Excellent particle size reduction has been achieved with media having a particle size of about 50 micrometers. In a useful embodiment, step (D) is carried out until 90% by weight of particles in the mixture are milled until they have a particle size less than 400 nm. In a particularly useful embodiment, step (D) is carried out until 10% by weight of the particles in the mixture have a particle size less than 100 nm; 50% by weight of said particles have a particle size less than 200 nm and 90% by weight of said particles have a particle size less than 400 nm. Similar desirable results can be achieved by the controlled precipitation method described below.

As used herein, particle size refers to a number average particle size as measured by conventional particle size measuring techniques well known to those skilled in the art, such as sedimentation field flow fractionation, photon correlation spectroscopy, or disk centrifugation. When photon correlation spectroscopy (PCS) is used as the method of particle sizing the average particle diameter is the Z-average particle diameter known to those skilled in the art. For example, by "an effective average particle size of less than about 1000 nm" and similar expressions, it is meant that at least 90% of the particles have a weight average particle size of less than about 1000 nm when measured by the above-noted techniques.

The preferred amounts and ratios of the ingredients of the nanoparticulate dispersions of the invention will vary widely depending upon the specific materials and the intended applications. The contents of the milling mixture comprise the mill grind and the milling media. The mill grind comprises carboxylate, surface modifier and a liquid carrier such as water. For aqueous based dispersions, the carboxylate is usually present in the mill grind at 1 to 50 weight %, excluding the milling media. The weight ratio of silver carboxylate particles to surface modifier is 100:1 to 1:2. The high-speed mill is a high agitation device, such as those manufactured by Morehouse-Cowles, Hockmeyer et al. The ratio of components in the final dispersion is the same as the ratio used in milling.

There are many different types of materials that may be used as milling media, such as glasses, ceramics, metals, and plastics. In a preferred embodiment, the milling (or grinding) media can comprise particles, preferably substantially spherical in shape, e.g., beads, consisting essentially of a polymeric resin.

In general, polymeric resins suitable for use herein are chemically and physically inert, substantially free of metals, solvent and monomers, and of sufficient hardness and friability to enable them to avoid being chipped or crushed during milling. Suitable polymeric resins include crosslinked polystyrenes, such as polystyrene crosslinked with divinylbenzene, styrene copolymers, polyacrylates such as poly(methyl methylacrylate), polycarbonates, polyacetals, such as Derlin™, vinyl chloride polymers and copolymers, polyurethanes, polyamides, poly (tetrafluoroethylenes), e.g., Teflon™, and other fluoropolymers, high density polyethylenes, polypropylenes, cellulose ethers and esters such as cellulose acetate, poly(hydroxyethylmethacrylate), poly (hydroxyethyl acrylate), silicone containing polymers such as polysiloxanes and the like. The polymer can be biodegradable. Exemplary biodegradable polymers include poly (lactides), poly(glycolids) copolymers of lactides and glycolide, polyanhydrides, poly(imino carbonates), poly(N-acylhydroxyproline) esters, poly(N-palmitoyl hydroxyprolino) esters, ethylene-vinyl acetate copolymers, poly(orthoesters), poly(caprolactones), and poly (phosphazenes). The polymeric resin can have a density from 0.9 to 3.0 g/cm$^3$. Higher density resins are preferred inasmuch as it is believed that these provide more efficient particle size reduction. Most preferred are crosslinked or uncrosslinked polymeric media based on styrene.

Milling takes place in a high-speed mill. By "high-speed mill", we mean milling devices capable of accelerating milling media to velocities greater than about 5 meters per second. The mill can contain a rotating shaft with one or more impellers. In such a mill the velocity imparted to the media is approximately equal to the peripheral velocity of the impeller, which is the product of the impeller revolutions per minute and the impeller diameter. Sufficient milling media velocity is achieved, for example, in Cowles-type saw tooth impeller having a diameter of 40 mm when operated at 9,000 rpm. The preferred proportions of the milling media, the carboxylate, the liquid dispersion medium and surface modifier can vary within wide limits and depends, for example, upon the particular material selected and the size and density of the milling media etc. The process can be carried out in a continuous, batch or semi-batch mode.

In the batch mode, an aqueous slurry of <500 micrometers milling media, water, carboxylate and surface modifier is prepared using simple mixing. This slurry may be milled in conventional high energy batch milling processes such as high speed attritor mills, vibratory mills, ball mills, etc. This slurry is milled for a predetermined length of time to allow comminution of the active material to a minimum particle size. After milling is complete, the nanoparticulate dispersion of the invention is separated from the grinding media by a simple sieving or filtration.

In a continuous mode, an aqueous slurry of <500 micrometers milling media, water, carboxylate and surface modifier may be continuously recirculated from a holding vessel through a conventional media mill which has a media separator screen adjusted to >500 micrometers to allow free passage of the media throughout the circuit. After milling is complete, the dispersion of the invention is separated from the grinding media by simple sieving or filtration.

In a mixed media milling process, a slurry of <500 micrometers milling media, liquid, carboxylate and surface modifier as indicated above may be continuously recirculated from a holding vessel through a conventional media mill containing milling media >750 micrometers. This mill should have a screen separator to retain the large media in the milling chamber while allowing passage of the small media through the milling chamber. After milling is complete, the dispersion of the invention is separated from the grinding media by simple sieving or filtration.

The milling time can vary widely and depends upon the carboxylate, mechanical means and residence conditions selected, the initial and desired final particle size, etc. For aqueous mill grinds using the preferred carboxlyates, surface modifiers, and milling media described above, milling times will typically range from 1 to 100 hours.

The particles must be reduced in size at a temperature that does not significantly degrade the carboxylate. Processing temperatures of less than about 30°–40° C. are ordinarily preferred. If desired, the processing equipment can be cooled with conventional cooling equipment. The method is conveniently carried out under conditions of ambient temperature and at processing pressures that are safe and effective for the milling process. For example, ambient processing pressures are typical for ball mills, attritor mills and vibratory mills. Processing pressures up to about 20 psi (1.4 kg/cm$^2$) are typical of media milling. Processing pressures from about 1 psi (0.07 kg/cm$^2$) up to about 50 psi (3.5 kg/cm$^2$) are contemplated. Processing pressures from about 10 psi (0.7 kg/cm$^2$) to about 20 psi (1.4 kg/cm$^2$) are preferred.

An alternative method of making the aqueous based nanoparticulate silver carboxylate dispersions used in the compositions of the invention is by controlled precipitation. According to one aspect of the present invention, a controlled precipitation method of making nanoparticulate silver carboxylate particles having on the surface of the particles a surface modifier which is a phosphoric acid, comprises the steps of:

a) introducing said surface modifier, water and carboxylic acid into a vessel;

b) solubilizing said carboxylic acid by introducing a basic salt;

c) introducing a water soluble silver salt so as to precipitate said silver carboxylate particles d) recovering said particles.

A useful controlled precipitation process is one used for the precipitation of photographic silver halide emulsions. The described surface modifier is introduced into a conventional reaction vessel for silver halide precipitation equipped with an efficient stirring mechanism. Typically, the surface modifier is initially introduced into the reaction vessel in at least an amount of about 5 percent, preferably 10 to 20 percent, by weight based on total weight of the surface modifier present in the nanoparticulate silver carboxylate at the conclusion of grain precipitation. Since the surface modifier can be removed from the reaction vessel by ultrafiltration during silver carboxylate grain precipitation, in a manner taught by Mignot U.S. Pat. No. 4,334,012, issued Jun. 8, 1982, it is appreciated that the amount of surface modifier initially present in the reaction vessel can equal or even exceed the amount of the silver carboxylate present in the reaction vessel at the conclusion of grain precipitation.

The surface modifier initially introduced into the reaction vessel is preferably aqueous solution or an aqueous dispersion of surface modifier, optionally containing other ingredients, such as one or more antifoggant and/or various dopants, more specifically described below. Where a surface modifier is initially present, it is preferably employed in a concentration of at least 5 percent, most preferably at least 10 percent, of the total silver carboxylate present at the completion of nanoparticulate dispersion precipitation. Additional surface modifier can be added to the reaction vessel with the water soluble silver salts and can also be introduced through a separate jet.

During precipitation, silver and carboxylate salts are added to the reaction vessel by known techniques such as those well known in the precipitation of photographic silver halide grains. The carboxylate salts are typically introduced as aqueous salt solutions, such as aqueous solutions of one or more soluble ammonium, alkali metal (e.g., sodium or potassium), or alkaline earth metal (e.g., magnesium or calcium) carboxylate salts. The silver salt is at least initially introduced into the reaction vessel separately from the carboxylate salt. The silver carboxylate can be precipitated in the presence of silver halide salts.

With the introduction of silver salt into the reaction vessel the nucleation stage of silver carboxylate grain formation is initiated. A population of grain nuclei is formed which is capable of serving as precipitation sites for silver carboxylate as the introduction of silver and/or carboxylic acid salts continues. The precipitation of silver carboxylate onto existing grain nuclei constitutes the growth stage of nanoparticulate grain formation.

As an alternative to the introduction of silver and (or) carboxylic acid salts as aqueous solutions, it is specifically contemplated to introduce the silver salt and carboxylic acid, initially or in the growth stage, in the form of ultrafine grains suspended in dispersing medium. The grain size is such that they readily react to form nanoparticulate silver carboxylate grains. The maximum useful grain sizes will depend on the specific conditions within the reaction vessel, such as temperature and the presence of solubilizing agents.

The concentrations and rates of silver, carboxylic acid salt introductions can take any convenient conventional form. The silver and carboxylic acid salts are preferably introduced in concentrations of from 0.1 to 5 moles per liter, although broader conventional concentration ranges, such as from 0.01 mole per liter to saturation, for example, are contemplated.

Specifically preferred precipitation techniques are those which achieve shortened precipitation times by increasing the rate of silver and carboxylic acid salt introduction during the run. The rate of silver and or carboxylic acid salt introduction can be increased either by increasing the rate at which the silver and or carboxylic acid salts are introduced or by increasing the concentrations of the silver and carboxylic acid salts within the solution.

The individual silver and (or) carboxylic acid salts can be added to the reaction vessel through surface or subsurface delivery tubes by gravity feed or by delivery apparatus for maintaining control of the rate of delivery and the pH, and/or pAg of the reaction vessel contents. In order to obtain rapid distribution of the reactants within the reaction vessel, specially constructed mixing devices can be employed.

In forming the aqueous based nanoparticulate silver carboxylate dispersions a surface modifier is initially contained in the reaction vessel. In a preferred form, the surface modifier is comprised of an aqueous solution. Surface modifier concentrations of from 0.1 to about 30 percent by weight, based on the total weight of dispersion components in the reaction vessel, can be employed. It is common practice to maintain the concentration of the surface modifier in the reaction vessel in the range of below about 15 percent, based on the total weight, prior to and during silver carboxylate formation. It is contemplated that the nanoparticulate silver carboxylate dispersion as initially formed will contain from about 1 to 200 grams of surface modifier per mole of silver carboxylate preferably about 10 to 150 grams of surface modifier per mole of silver carboxylate. Additional surface modifier can be added later to bring the concentration up to as high as 300 grams per mole of silver carboxylate.

Vehicles (which include both binders and peptizers) can be employed. Preferred peptizers are hydrophilic colloids, which can be employed alone or in combination with hydrophobic materials. Suitable hydrophilic materials include substances such as proteins, protein derivatives, cellulose derivatives e.g., cellulose esters, gelatin e.g., alkali-treated gelatin (cattle bone or hide gelatin) or acid-treated gelatin (pigskin gelatin), gelatin derivatives e.g., acetylated gelatin, phthalated gelatin and the like, polysaccharides such as dextran, gum arabic, zein, casein, pectin, collagen derivatives, agaragar, arrowroot, albumin and the like.

Other materials commonly employed in combination with hydrophilic colloid peptizers as vehicles (including vehicle extenders—e.g., materials in the form of lattices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like. These additional materials need not be present in the reaction vessel during nanoparticulate silver carboxylate precipitation, but rather are conventionally added to the dispersion prior to coating. The vehicle materials, including particularly the hydrophilic colloids, as well as the hydrophobic materials useful in combination therewith can be employed not only in the emulsion layers of the described photographic, but also in other layers, such as overcoat layers, interlayers and layers positioned beneath the emulsion layers.

The aqueous based nanoparticulate silver carboxylate dispersions used in the present invention are preferably free of soluble salts. The soluble salts can be removed by decantation, filtration, and/or chill setting and leaching, by centrifugation and decantation of a coagulated dispersion, by employing hydrocyclones alone or in combination with centrifuges, by diafiltration with a semipermeable membrane, or by employing an ion exchange resin.

A variety of organic reducing agents are useful in the described oxidation-reduction compositions according to the invention. These are typically silver halide developing agents that produce the desired oxidation-reduction image-forming reaction upon exposure and heating of the described photothermographic (or thermographic) silver halide material. Examples of useful reducing agents include: polyhydroxybenzenes, such as hydroquinone and alkyl substituted hydroquinones; catechols and pyrogallol; phenylenediamine developing agents; aminophenol developing agents; ascorbic acid developing agents, such as ascorbic acid and ascorbic acid ketals and other ascorbic acid derivatives; hydroxylamine developing agents; 3-pyrazolidone developing agents such as 1-phenyl-3-pyrazolidone and 4-methyl-4-hydroxymethyl-1-phenyl-3-pyrazolidone; hydroxytetronic acid and hydroxytetronamide developing agents; reductone developing agents; bis-naphthol reducing agents; sulfonamidophenol reducing agents and the like. Combinations of organic reducing agents can be useful in the described photothermographic silver halide materials.

A range of concentration of the organic reducing agent can be useful in the described photothermographic silver halide materials. The concentration of organic reducing agent is typically within the range of about 5 $mg/dm^2$ to about 20 $mg/dm^2$, such as within the range of about 10 to about 17 $mg/dm^2$. The optimum concentration of organic reducing agent will depend upon such factors as the particular carboxylate, e.g. long-chain fatty acid, the desired image, processing conditions, the particular solvent mixture, coating conditions and the like.

In accordance with the invention, there is provided an oxidation-reduction imaging forming composition comprising an aqueous based dispersion of (i) nanoparticulate silver carboxylate particles having on the surface of the particles a surface modifier which is a phosphoric acid ester and (ii) an organic reducing agent. Such a composition is useful, for example, in a thermographic element. An image can be formed in such an element by imagewise heating. Imagewise heating can be accomplished using an array of heating elements as the element is passed through a machine similar to a facsimile machine.

Thermographic elements are known and the nanoparticulate dispersion of silver carboxylate particles as described herein is the "oxidizing agent" described for this type of element. Useful elements of this type are described, for example, in U.S. Pat. No. 5,994,052 issued Nov. 30, 1999; U.S. Pat. No. 5,928,856 issued Jul. 27, 1999; U.S. Pat. No. 5,928,855 issued Jul. 27, 1999; and U.S. Pat. No. 5,922,528 issued Jul. 13, 1999.

In another aspect, the compositions can be used in photothermographic elements wherein a photosensitive silver halide is also present. Exposure of the silver halide produces a latent image that is then developed by a composition including nanoparticulate silver carboxylate particles and an organic reducing agent. An aqueous based photothermographic composition can be prepared by very thoroughly mixing (I) a hydrophilic photosensitive silver halide emulsion with (II) (a) a hydrophilic binder and (b) an oxidation-reduction image-forming composition comprising an aqueous based dispersion of (i) an aqueous nanoparticulate dispersion of a silver carboxylate with (ii) an organic reducing agent in water. A photothermographic element can be prepared by coating the resulting photothermographic composition on a suitable support.

The aqueous photothermographic materials can comprise a photosensitive silver halide. The photosensitive silver halide is in the form of a hydrophilic photosensitive silver halide emulsion containing a peptizer. The peptizer is typically gelatin but can be other known silver halide peptizers. The photosensitive silver halide is especially useful due to its high degree of photosensitivity compared to other photosensitive components. A typical concentration of hydrophilic photosensitive silver halide emulsion containing a peptizer and the imaging forming composition is within the range of about 0.02 to about 1.0 mole of photosensitive silver halide per mole of the described silver salt of a long-chain fatty acid in the photothermographic material. Other photosensitive materials can be useful in combination with the described photosensitive silver halide if desired. Preferred photosensitive silver halides are silver chloride, silver bromoiodide, silver bromide, silver chlorobromoiodide or mixtures thereof Silver iodide is also considered to be a photosensitive silver halide. A range of grain size and grain morphology of photosensitive silver halide from very coarse grain to very fine grain and from 3D to tabular silver halide is useful. Tabular grain photosensitive silver halide is useful, as described in, for example, U.S. Pat. No. 4,435,499 issued Mar. 6, 1984. Very fine grain silver halide is preferred.

The hydrophilic photosensitive silver halide emulsion containing a peptizer can be prepared by any of the procedures known in the photographic art which involve the preparation of photographic silver halide emulsion. Useful procedures and forms of photosensitive silver halide emulsions are described in, for example, the Product Licensing Index, Volume 92, December 1971, Publication 9232 on page 107, published by Industrial Opportunities Limited, Homewell, Havant Hampshire, P09 1EF, UK. The photographic silver halide, as described, can be washed or unwashed, can be chemically sensitized using chemical sensitization procedures. Materials known in the photographic art can be protected against the production of fog and stabilized against loss of sensitivity during keeping as described in the mentioned Product Licensing Index publication.

A hydrophilic photosensitive silver halide emulsion containing a peptizer that contains a low concentration of gelatin is often very useful. The concentration of gelatin that is very useful is typically within the range of about 9 to about 15 grams per mole of silver.

The term "hydrophilic" is intended herein to mean that the photosensitive silver halide emulsion containing a peptizer is compatible with an aqueous solvent.

The peptizer can be a gelatino peptizer that is useful with the photosensitive silver halide emulsion and can comprise a variety of gelatino peptizers known in the photographic art. The gelatino peptizer can be, for example, phthalated gelatin or non-phthalated gelatin. Other gelatino peptizers that are useful include acid or base hydrolyzed gelatins.

The photosensitive silver halide emulsion can contain a range of concentration of the peptizer. Typically, the concentration of the peptizer is within the range of about 5 grams to about 40 grams of peptizer, such as gelatin, per mole of silver in the silver halide emulsion. This is described herein as a low-gel silver halide emulsion. An especially useful concentration of peptizer is within the range of about 9 to about 15 grams of peptizer per mole of silver in the silver halide emulsion. The optimum concentration of the peptizer will depend upon such factors as the particular photosensitive silver halide, the desired image, the particular components of the photothermographic composition, coating conditions and the like. Typically, the silver halide emulsion pH is maintained within the range of about 5.0 to about 6.2 during the emulsion precipitation step. Lower pH values may cause undesired coagulation and higher pH values may cause undesirable grain growth.

A particularly preferred peptizer is a cationic starch as taught by Maskasky U.S. Pat. No. 5,604,085, issued Feb. 18, 1997, U.S. Pat. No. 5,620,840, issued Apr. 15, 1997, U.S. Pat. No. 5,667,955, issued Sep. 16, 1997, U.S. Pat. No. 5,691,131, issued Nov. 25, 1997, and U.S. Pat. No. 5,733,718, issued Mar. 31, 1998. In photothermographic elements, photosensitive silver halide grains made using water dispersible cationic starch solve the problems of higher than desired fog and less than optimum raw stock keeping.

The temperature of the reaction vessel within which the silver halide emulsion is prepared is typically maintained within a temperature range of about 35° C. to about 75° C. during the composition preparation. The temperature range and duration of the preparation can be altered to produce the desired emulsion grain size and desired composition properties. The silver halide emulsion can be prepared by means of emulsion preparation techniques and apparatus known in the photographic art.

An especially useful method for preparation of the photothermographic composition is by a simultaneous double-jet emulsion precipitation techniques.

A variety of hydrophilic binders are useful in the described photothermographic materials. The binders that are useful include various colloids alone or in combination as vehicles and/or binding agents. The hydrophilic binders which are suitable include transparent or translucent materials and include both naturally occurring substances, such as proteins, gelatin, gelatin derivatives, cellulose derivatives, polysaccharides, such as dextrin, gum arabic and the like: and synthetic polymeric substances such as water-soluble polyvinyl compounds like polyvinyl alcohol, poly(vinyl pyrrolidone), acrylamide polymers and the like. Other synthetic polymeric compounds, which can be employed include dispersed vinyl compounds such as latex form and particularly those that increase dimensional stability of photographic materials. A range of concentration of hydrophilic binder can be useful in the photothermographic silver halide materials according to the invention. Typically, the concentration of hydrophilic binder in a photothermographic silver halide composition according to the invention is within the range of about 50 to about 1000 mg/dm$^2$. An optimum concentration of the described binder can vary depending upon such factors as the particular binder, other components of the photothermographic material, coating conditions, desired image, processing temperature and conditions and the like.

If desired, a portion of the photographic silver halide in the photothermographic composition can be prepared in situ in the photothermographic material. The photothermographic composition, for example, can contain a portion of the photographic silver halide that is prepared in or on one or more of the other components of the described photothermographic material rather than prepared separate from the described components and then admixed with them. Such a method of preparing silver halide in situ is described in, for example, U.S. Pat. No. 3,457,075 of Morgan et al., issued Jul. 22, 1969.

The described photothermographic composition comprises an oxidation-reduction image-forming combination containing a silver carboxylate, which can be a long-chain fatty acid silver salt, with a suitable reducing agent. The oxidation-reduction reaction resulting from this combination upon heating is believed to be catalyzed by the latent image silver from the photosensitive silver halide produced upon imagewise exposure of the photothermographic material followed by overall heating of the photothermographic material. The exact mechanism of image formation is not fully understood.

A variety of silver salts of long-chain fatty acids are useful in the photothermographic material. The term "long-chain" as used herein is intended to refer to a fatty acid containing 8 to 30 carbon atoms and which is typically resistant to darkening upon exposure to light. Useful long-chain fatty acid silver salts include, for example, silver stearate, silver behenate, silver caprate, silver hydroxystearate, silver myristate and silver palmitate. A minor proportion of another silver salt oxidizing agent which is not a long-chain fatty acid silver salt can be useful in combination with the silver salt of the long-chain fatty acid if desired. Such silver salts which can be useful in combination with the described silver salts of a long-chain fatty acid include, for example, silver benzotriazole, silver imidazole, silver benzoate and the like. Combinations of silver salts of long-chain fatty acids can be useful in the described photothermographic materials if desired.

The silver carboxylate salt often contains measurable amounts (e.g. about 1–20 preferably 5–15% by weight of silver carboxylate) carboxylic acid and/or non-silver carboxylate salts.

The order of addition of the described components, as described in the examples, for preparing the photothermographic composition before coating the composition onto a suitable support is important to obtain optimum photographic speed, contrast and maximum density.

A variety of mixing devices are useful for preparing the described compositions. However, the mixing device should be one that provides very thorough mixing. Mixing devices that are useful are commercially available colloid mill mixers and dispersator mixers known in the photographic art.

It is desirable, in some cases, to have what is described as a toning agent, also known as an activator-toning agent, in the photothermographic material according to the invention. Combinations of toning agents can often be useful. Typical toning agents include, for example, phthalimide, succinimide, N-hydroxyphthalimide, N-hydroxy-1,8-naphthalimide, N-hydroxysuccinimide, 1-(2H) phthalazinone and phthalazinone derivatives.

Photothermographic materials can contain other addenda that are useful in imaging. Suitable addenda in the described photothermographic materials include development modifiers that function as speed-increasing compounds, hardeners, antistatic layers, plasticizers and lubricants, coating aids, brighteners, spectral sensitizing dyes, antifogants, charge control agents, absorbing and filter dyes, matting agents and the like.

The specific addenda depend on the exact nature of the imaging element. The compositions and elements described in this specification are useful for forming laser output media useful for reproducing x-ray images; are useful for forming microfilm elements and are useful to form graphic arts elements. Each of these applications has well known features requiring specialized addenda known in the respective arts for these elements.

An important advantage of these aqueous based nanoparticulate silver carboxylate containing oxidation-reduction image forming compositions is that they can be coated from an aqueous environment. Several current elements of this type are currently coated from organic solvents. The present invention can be used to convert these products into aqueous coated products. In this process, some of the components typically found in these elements may not be as soluble in water as desired. These components also can be made into nanoparticulate dispersions using the same or compatible surface modifiers as are described.

It is useful in certain cases to include a stabilizer in the described photothermographic material. This can help in stabilization of a developed image. Combinations of stabilizers can be useful if desired. Typical stabilizers or stabilizer precursors include certain halogen compounds, such as tetrabromobutane and 2-(tribromomethylsulfonyl, benzothiazole, which provide improved postprocessing stability and azothioethers and blocked azoline thione stabilizer precursors.

A photothermographic element can have a transparent protective layer comprising a film forming binder, preferable a hydrophilic film forming binder. Such binders include, for example, crosslinked polyvinyl alcohol, gelatin, poly(silicic acid), and the like. Particularly preferred are binders comprising poly(silicic acid) alone or in combination with a water-soluble hydroxyl-containing monomer or polymer as described in the U.S. Pat. No. 4,828,971 issued May 9, 1989 to Przezdziecki.

The term "protective layer" is used to mean a transparent, image insensitive layer that can be an overcoat layer, that is a layer that overlies the image sensitive layer(s). The protective layer can also be a backing layer, that is, a layer that is on the opposite side of the support from the image sensitive layer(s). The imaging element can contain an adhesive interlayer or adhesion promoting interlayer between the protective layer and the underlying layer(s). The protective layer is not necessarily the outermost layer of the imaging element.

The protective layer can contain an electrically conductive layer having a surface resistivity of less than $5\times10^{11}$ ohms/square. Such electrically conductive overcoat layers are described, for example, in U.S. Pat. No. 5,547,821 issued Aug. 20, 1996 to Melpolder et al.

A photothermographic imaging element can include at least one transparent protective layer containing matte particles. Either organic or inorganic matte particles can be used. Examples of organic matte particles are beads of polymers such as polymeric esters of acrylic and methacrylic acid, e.g., poly(methylmethacrylate), styrene polymers and copolymers, and the like. Examples of inorganic matte particles are glass, silicon dioxide, titanium dioxide, magnesium oxide, aluminum oxide, barium sulfate, calcium carbonate, and the like.

A wide variety of materials can be used to prepare the protective backing layer that is compatible with the requirements of photothermographic elements. The protective layer should be transparent and should not adversely affect sensitometric characteristics of the photothermographic element such as minimum density, maximum density and photographic speed. Useful protective layers include those comprised of poly(silicic acid) and a water-soluble hydroxyl containing monomer or polymer that is compatible with poly(silicic acid) as described in U.S. Pat. No. 4,741,992 issued May 3, 1988 and U.S. Pat. No. 4,828,971 issued May 9, 1989. A combination of poly(silicic acid) and poly(vinyl alcohol) is particularly useful. Other useful protective layers include those formed from polymethylmethacrylate, acrylamide polymers, cellulose acetate, crosslinked polyvinyl alcohol, terpolymers of acrylonitrile, vinylidene chloride, and 2-(methacryloyloxy)ethyl-trimethylammonium methosulfate, crosslinked gelatin, polyesters and polyurethanes.

Particularly preferred protective layers are described in above-mentioned U.S. Pat. No. 5,310,640 issued May 10, 1994 and U.S. Pat. No. 5,547,821 issued Aug. 20, 1996.

The photothermographic elements can comprise a variety of supports that can tolerate the processing temperatures useful in developing an image. Typical supports include cellulose ester, poly(vinyl acetal), poly(ethylene terephthalate), polycarbonate and polyester film supports. Related film and resinous support materials, as well as paper, glass, metal and the like supports that can withstand the described processing temperatures are also useful. Typically a flexible support is most useful.

Coating procedures known in the photographic art can coat the photothermographic compositions on a suitable support. Useful methods including dip coating, air-knife coating, bead coating using hoppers, curtain coating or extrusion coating using hoppers. If desired, two or more layers can be coated simultaneously.

The described silver halide and oxidation-reduction image-forming combination can be in any suitable location in the photothermographic element which produces the desired image. In some cases it can be desirable to include certain percentages of the described reducing agent, the silver salt oxidizing agent and/or other addenda in a protective layer or overcoat layer over the layer containing the other components of the element as described. The components, however, must be in a location that enables their desired interaction upon processing.

It is necessary that the photosensitive silver halide, as described and other components of the imaging combination be "in reactive association" with each other in order to produce the desired image. The term "in reactive association," as employed herein, is intended to mean that the photosensitive silver halide and the image-forming combination are in a location with respect to each other, which enables the desired processing and produces a useful image.

A useful embodiment is a photothermographic silver halide composition capable of being coated on a support. The composition comprises an aqueous based dispersion of (a) an aqueous photosensitive silver halide emulsion containing a peptizer with (b) a hydrophilic polymeric binder consisting essentially of a polyvinylalcohol and (c) an oxidation-reduction image-forming combination comprising (i) nanoparticles of a silver salt of a long-chain fatty acid consisting essentially of silver behenate and a surface modifier as described (ii) an organic reducing agent consisting essentially of a sulfonamidophenol. This composition can be coated on a suitable support to produce a photothermographic element. Another embodiment is a method of preparing a photothermographic element comprising coating the resulting composition onto a suitable support to produce a photothermographic element as desired.

Elements can be imaged using a variety of methods. The elements can be imaged using any suitable source of radiation to which the photothermographic material is sensitive. The imaging materials are typically sensitive to the ultraviolet and blue regions of the spectrum and exposure sources that provide this radiation are preferred.

Typically, however, if a spectral sensitizing dye (or combination of spectral sensitizing dyes) is present in the photothermographic material, exposure using other ranges of the electromagnetic spectrum can be useful. Typically, a photothermographic element is exposed imagewise with a visible light source, such as a tungsten lamp or laser or an infrared light source, such as a laser or a light emitting diode (LED). Other sources of radiation can be useful and include, for instance, electron beams, X-ray sources and the like. The photothermographic materials are typically exposed imagewise to produce a developable latent image.

A visible image can be developed in the photothermographic element within a short time, such as within several seconds, merely by heating the photothermographic material to moderately elevated temperatures. For example, the exposed photothermographic material can be heated to a temperature within the range of about 100° C. to about 200° C., such as a temperature within the range of about 110° C. to about 140° C. Heating is carried out until a desired image is developed, typically within about 2 to about 30 seconds, such as 2 to 10 seconds. Selection of an optimum processing time and temperature will depend upon such factors as the desired image, particular components of the photothermographic element, the particular latent image and the like.

The necessary heating of the described photothermographic material to develop the desired image can be accomplished in a variety of ways. Heating can be accomplished using a simple hot plate, iron, roller, infrared heater, hot air or the like.

Processing is typically carried out under ambient conditions of pressure and humidity. Pressures and humidity outside normal atmospheric conditions can be useful if desired; however, normal atmospheric conditions are preferred.

PREPARATION 1

Preparation of an Aqueous Nanoparticulate Silver Behenate (AgBeh) Colloidal Dispersion Using Media Milling An aqueous AgBeh nanoparticulate dispersion was prepared by media milling of an aqueous microparticulate AgBeh dispersion as follows.

The following ingredients were blended in a 2-liter cylindrical, water-cooled vessel:

1) 385.7 grams of, 35% solids, aqueous silver behenate (AgBeh) "wet cake" also containing 6% by weight behenic acid based on silver behenate;
2) 16.2 grams of 100% active Emphos™-CS1361 from Witco surface modifier;
3) 96.3 grams of de-ionized water; and
4) 500 grams of poly(styrene-co-divinylbenzene)-20/80 beads (milling media) with mean diameter of 50 micrometers.

The resulting mixture was agitated for 4 hours at high-speed (5000 rpm) using a Cowles-type saw tooth impeller (40 mm diameter) at the temperature of 4.4° C.

The milling media was separated from this mixture using a 15 micrometer filter.

PREPARATION 2

This is a comparative preparation.

Preparation of an Aqueous Microparticulate Silver Behenate (AgBeh) Colloidal Dispersion An aqueous AgBeh microparticulate dispersion was prepared AgBeh dispersion as follows.

The following ingredients were blended in a 5 liter container:

1) 600 grams of, 35% solids, aqueous silver behenate (AgBeh) "wet cake";
2) 676.1 grams of 8% aqueous solution of polyvinyl alcohol (PVA, Elvanol™ 52-22 86–89% hydrolyzed (Dupont))

The resulting mixture was mixed for 2 hours at high-speed (4200 rpm) using a Cowles-type saw tooth impeller (40 mm diameter) at the temperature of 21° C.

The particle morphology was characterized using scanning electron microscopy and particle size distribution of the resulting nanoparticulate dispersion was determined using a Horiba LA-920 Ultra Fine Particle Analyzer (Horiba Instruments Inc).

The particle size distribution curves (FIG. 1) indicate that the micromilling process carried out in the presence of the surface modifier according to this invention (Preparation 1, Emphos™ CS-1361 phosphoric acid ester, curve A) provides a significantly smaller AgBeh particle size and a narrower particle size distribution than the high shear mixing process carried out in the absence of surface modifier according to this invention. (Comparative Preparation 2, polyvinyl alcohol, curve B).

EXAMPLE 1

Aqueous Photothermographic Imaging Element Formulated Using Nanoparticulate AgBeh Dispersion A coating mixture suitable for preparing an aqueous photothermographic imaging layer comprising an aqueous nanoparticulate AgBeh dispersion prepared as described in Preparation 1 was prepared by combining 162.1 grams of 6.2% aqueous solution of polyvinyl alcohol (PVA, Elvanol™ 52-22 86–89% hydrolyzed (Dupont)) with 154.32 grams of nanoparticulate silver behenate dispersion of Preparation 1. To this mixture was added 2.8 grams of succinimide, 0.34 grams of sodium iodide, and 3.23 g of 4 g/l aqueous solution of mercuric bromide. The mixture was stirred overnight. A primitive iodobromide cubic emulsion, $Br_{97}I_3$, 57 nanometer in edge length, and containing 20 g/silver mole gelatin was spectrally sensitized with RD-1, by adding 22.1 gram of a 0.19% 1:1 methanol water solution of RD-1 to 14.8 gram of the emulsion (0.922 kg/mol). The silver behenate mixture described above was combined with 36.9 g of spectrally sensitized emulsion. This mixture was combined with 39.1 grams of a solid particle dispersion of developer Dev-1. The solid particle dispersion had been prepared by milling a 15% solution of Dev-1, with 1.2% PVP and 0.3% SDS in water.

A thermally processable imaging element was prepared by coating a blue (0.14 density) gelatin subbed poly (ethylene terephthalate) support, having a thickness of 0.178 mm, with a photothermographic imaging layer and a protective overcoat. The layers of the thermally processable imaging element were coated on a support by extrusion coating using hoppers. The photothermographic imaging composition was coated from aqueous solution at a wet coverage of 93.48 g/m$^2$ to form an imaging layer of the following dry composition

TABLE 1

Photothermographic Imaging Layer dry coverage

| Components | Dry Coverage (g/m$^2$) |
|---|---|
| Succinimide | 0.753 |
| Dev-1 | 1.578 |
| Silver iodobromide cube 57 nanometers silver level | 0.472 |
| RD-1 | 0.011 |
| Silver behenate | 6.89 |

TABLE 1-continued

| Photothermographic Imaging Layer dry coverage | |
|---|---|
| Components | Dry Coverage ($g/m^2$) |
| Polyvinyl Alcohol (PVA. Elvanol 52–22 from Dupont, 86–89% hydrolyzed) | 3.23 |
| Sodium Iodide, USP | .091 |
| Mercuric bromide | 0.00194 |

The resulting imaging layer was then overcoated with mixture of polyvinyl alcohol and hydrolyzed tetraethyl orthosilicate as described in Table 2 at a wet coverage of 40.4 $cc/m^2$ and dry coverage shown in Table 3.

TABLE 2

| Overcoat Solution | |
|---|---|
| Component | Grams |
| Distilled Water | 1158.85 grams |
| Polyvinyl Alcohol (PVA, Elvanol ™ 52-22 from Dupont, 86–89% hydrolyzed) (6.2% by weight in distilled water) | 763.43 |
| Tetraethyl Orthosilicate solution comprising of 178.5 grams of water 1.363 grams of p-Toluene Sulfonic Acid, 199.816 grams of Methanol, 207.808 grams of Tetraethyl Orthosilicate | 489.6 |

TABLE 2-continued

| Overcoat Solution | |
|---|---|
| Component | Grams |
| Aerosol ™ OT (0.15% by weight in distilled water. (Aerosol ™ OT is a sodium bis-2-ethylhexyl sulfosuccinate surfactant and is available from the Cytec Industries, Inc.., U.S.A.) | 75.00 |
| Zonyl ™ FSN (0.05% by weight in distilled water. (Zonyl ™ FSN surfactant is a mixture of fluoro-alkyl poly(ethyleneoxide) alcohols and is a trademark of and available from the Dupont Corp., U.S.A.) | 3.13 |
| Silica (1.5 micron) | 3.0 |

TABLE 3

| Overcoat layer dry coverage | |
|---|---|
| PSA (Silicate) | 1.302 |
| PVA | 0.872 |
| Aerosol ™ OT | 0.0624 |
| Zonyl ™ FSN | 0.0207 |

The imaging element was exposed using the 683 nm, 50 mW, diode laser sensitometer and heat processed at 121° C. for 5 sec to produce a developed silver image.

TABLE 4

| Structures of Materials Described in Example 1 | |
|---|---|
| 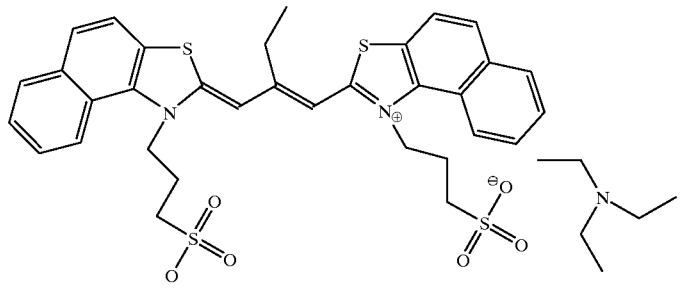 | Red Dye RD-1 |
| 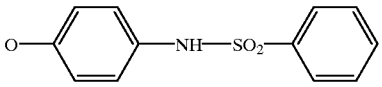 | Developer Dev-1 |
| 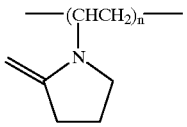 | PVP |
| $H_3(CH_2)_{11}—SO_4^-Na^+$ | SDS |

EXAMPLE 2

This is a Comparative Example

Aqueous Photothermographic Imaging Element Formulated Using Microparticulate AgBeh Dispersion.

A photothermographic element was formulated, coated, exposed and heat processed as described in Example 1 except that the nanoparticulate dispersion of Example 1 was replaced with the microparticulate dispersion of Preparation 2. The resulting sensitometric curves show that the element of the invention is about 0.2 Log E faster than the microparticulate dispersion.

PREPARATIONS 3–14

An aqueous nanoparticulate silver behenate colloidal dispersion was prepared as described in Preparation 1 except that the Emphos™ CS-1361. dispersing aid was replaced by dispersing aid listed in Table 5.

The mean particle sizes for these dispersions were determined in the manner described in Example 1 and are reported in Table 5.

TABLE 5

| Preparation # | Surface Modifier | Source | % Sufactant vs. AgBeh | Milling Time hours | Milling Temp. ° C. | Mean Particle Size microns |
|---|---|---|---|---|---|---|
| 3 | Emphos ™-CS147 | Witco Corp. | 12 | 4 | 4.4 | 0.183 |
| 4 | Emphos ™-CS9NP | Witco Corp. | 12 | 4 | 4.4 | 0.202 |
| 5 | Emphos ™-PS121 | Witco Corp. | 12 | 4 | 4.4 | 0.207 |
| 6 | Emphos ™-PS131 | Witco Corp. | 12 | 4 | 4.4 | 0.385 |
| 7 | Rhodofac ™-RE410 | Rhodia Inc. | 12 | 4 | 4.4 | 0.389 |
| 8 | Rhodofac ™-RE610 | Rhodia Inc. | 12 | 4 | 4.4 | 0.46 |
| 9 | Rhodofac ™-RS610 | Rhodia Inc. | 12 | 4 | 4.4 | 0.485 |
| 10 | T-Mulz ™-598 | Harcross Chem. Inc. | 12 | 4 | 4.4 | 0.161 |
| 11 | T-Mulz 7861 | Harcross Chem. Inc. | 12 | 4 | 4.4 | 0.135 |
| 12 | Tryfac ™-5556 | Henkel Corp. | 12 | 4 | 4.4 | 0.387 |
| 13 | Servoxyl ™ VPNZ 7/100 | Condea | 12 | 4 | 4.4 | 0.156 |
| 14 | Servoxyl ™ VPNZ 9/100 | Condea | 12 | 4 | 4.4 | 0.203 |

PREPARATION 15

Preparation of an Aqueous Nanoparticulate Silver Behenate (AgBeh) Colloidal Dispersion Using Controlled Precipitation A 18 liter reactor was charged with 9.97 kg of water, 363 g of 1.87% aqueous solution of Emphos™ CS-147 surfactant, and 279.6 g of behenic acid. The contents were stirred at 150 RPM with an anchor stirrer and heated to 70° C. Once the mixture reached 70° C., 390.7 g of 10.85% aqueous potassium hydroxide were added to the reactor. The mixture was heated to 80° C. and held there for 30 minutes. The mixture was then cooled to 70° C. When the reactor reached 70° C., 1000 g of 12.77% aqueous silver nitrate were fed to the reactor in 5 minutes. After the addition, the nanoparticulate silver behenate was held at the reaction temperature for 30 minutes. It was then cooled to room temperature and decanted. A silver behenate dispersion also containing 9% by weight of behenic acid based on silver behenate, the dispersion having a median particle size of 140 nm was obtained.

Procedure for Purifying and Concentrating Nanoparticulate Silver Behenate Dispersions 12 kg of 3% solids nanoparticulate silver behenate dispersion were loaded into the hopper of a diafiltration/ultrafiltration apparatus. The permeator membrane cartridge was an Osmonics model 21-HZ20-S8J that has an effective surface area of 3.7 square feet (0.344 square meters) and a nominal molecular weight cutoff of 50,000. The pump was turned on and the apparatus was run so that the pressure going into the permeator was 50 psig (2585 Torr) and the pressure downstream from the permeator was 20 psig (1034 Torr). The permeate was replaced with deionized water until 24 kg of permeate had been removed from the dispersion. At this point, the replacement water was turned off and the apparatus was run until the dispersion had been concentrated to 28% solids. The yield was 886 grams.

EXAMPLE 3

Aqueous Photothermographic Imaging Element Formulated Using Nanoparticulate AgBeh Dispersion Made Using Controlled Precipitation A photothermographic in element similar to that disclosed in Example 1 was prepared using a silver behenate dispersion as described in Preparation 15.

A coating mixture suitable for preparing an aqueous photothermographic imaging layer comprising an aqueous nanoparticulate AgBeh dispersion prepared as described in Preparation 15 was prepared by combining 162.79 grams of 7% aqueous solution of polyvinyl alcohol (PVA, Elvanol™ 52-22 86–89% hydrolyzed (Dupont)) with 110.37 grams of nanoparticulate silver behenate dispersion of Preparation 15. To this mixture was added 2.85 grams of succinimide, 1.87 grams of 185 g/l of an aqueous solution of sodium iodide, and 3.29 g of 4 g/l aqueous solution of mercuric bromide. The mixture was stirred overnight. A primitive iodobromide cubic emulsion, $Br_{97}I_3$, 57 nanometer in edge length, and containing 20 g/silver mole gelatin was spectrally sensitized with a combination DA-1 and IRD-1, by adding 3.53 grams of 3 g/l aqueous solution of DA-1 and 2.54 grams of a 1.0% methanol solution of IRD-1 to 16.7 gram of the emulsion (0.922 kg/mol). The silver behenate mixture described above in Preparation 15 was combined with 16.7 g of spectrally sensitized emulsion. This mixture was combined with 39.78 grams of a solid particle dispersion of developer Dev-1. The solid particle dispersion had been prepared by milling a 15% solution of Dev-1, with 1.2% PVP and 0.3% SDS in water.

A thermally processable imaging element was prepared by coating a blue (0.14 density) gelatin subbed poly (ethylene terephthalate) support, having a thickness of 0.178 mm, with a photothermographic imaging layer and a protective overcoat. The layers of the thermally processable imaging element were coated on a support by extrusion coating using hoppers. The photothermographic imaging composition was coated from aqueous solution at a wet coverage of 88.28 g/m$^2$ to form an imaging layer of the following dry composition:

TABLE 1

Photothermographic Imaging Layer dry coverage

| Components | Dry Coverage (g/m$^2$) |
|---|---|
| Succinimide | 0.761 |
| Dev-1 | 1.593 |
| Silver iodobromide cube 57 nanometers silver level | 0.471 |
| DA-1 | 0.0022 |
| IRD-1 | 0.0052 |
| Silver behenate | 6.956 |

TABLE 1-continued

Photothermographic Imaging Layer dry coverage

| Components | Dry Coverage ($g/m^2$) |
|---|---|
| Polyvinyl Alcohol (PVA, Elvanol 52-22 from Dupont, 86–89% hydrolyzed) | 3.261 |
| Sodium Iodide, USP | .092 |
| Mercuric bromide | 0.00196 |

The resulting imaging layer was then overcoated with mixture of polyvinyl alcohol and hydrolyzed tetraethyl orthosilicate as described in Table 2 at a wet coverage of 40.4 $cc/m^2$ and dry coverage shown in Table 3.

The imaging element was exposed using the 810 nm, 50 mW, diode laser sensitometer and heat processed at 122° C. for 9 sec to produce a developed silver image having a Dmax of 3.5 and a Dmin of 0.2.

The structures of IRD-1 is:

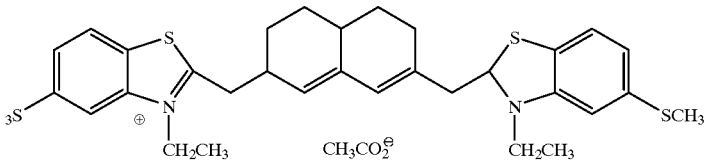

The structure of DA-1 is:

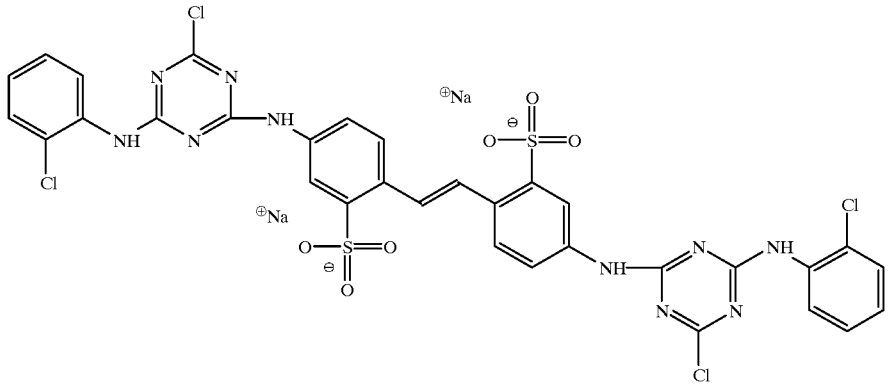

What is claimed is:

1. An oxidation-reduction image forming composition comprising an aqueous based dispersion of (i) nanoparticulate silver carboxylate particles having on the surface of the particles a surface modifier which is a phosphoric acid ester and (ii) an organic reducing agent.

2. An oxidation-reduction imaging forming composition according to claim 1 wherein said dispersion also contains about 1–20% by weight of carboxylic acid by weight of silver carboxylate.

3. An oxidation-reduction imaging forming composition according to claim 1 wherein said silver carboxylate is a silver salt of a long chain fatty acid.

4. An oxidation-reduction imaging forming composition according to claim 3 said silver salt is a salt of a long chain fatty acid containing 8 to 30 carbon atoms.

5. An oxidation-reduction imaging forming composition according to claim 4 wherein said silver carboxylate is silver behenate.

6. An oxidation-reduction imaging forming composition according to claim 1 wherein said surface modifier is a mixture of mono- and di-esters of orthophosphoric acid and hydroxyl-terminated, oxyethylated long-chain alcohols or oxyethylated alkyl phenols.

7. An oxidation-reduction imaging forming composition according to claim 1 wherein said surface modifier is represented by the general structure:

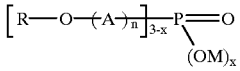

where x=1 or 2;

where R is either an alkyl group, straight chain or branched chain, with between 8 and 16 carbon atoms, or an alkyl phenyl group with between 12 and 16 carbon atoms, the alkyl group being in the para position relative to the oxygen atom, O; A is an ethylene oxide group (—$CH_2CH_2O$—), or a propylene oxide group, or a mixture of both groups; n has average values of between 3 and 12; and M is either hydrogen or an alkali metal cation.

8. A thermographic element comprising a support having thereon an imaging layer comprising an aqueous oxidation-reduction imaging forming composition comprising (i) a nanoparticulate dispersion of silver carboxylate particles having on the surface of the particles a surface modifier which is a phosphoric acid ester and (ii) an organic reducing agent

9. An photothermographic composition comprising an aqueous based dispersion of a) a photosensitive silver halide emulsion containing a peptizer and b) an oxidation-reduction imaging forming composition comprising (i) nanoparticles of silver carboxylate particles having on the surface of the particles a surface modifier which is a phosphoric acid ester and (ii) an organic reducing agent.

10. An photothermographic composition according to claim 9 wherein said dispersion also contains about 1–20% by weight of carboxylic acid by weight of silver carboxylate.

11. A photothermographic composition according to claim 9 wherein said silver carboxylate is a silver salt of a long chain fatty acid.

12. A photothermographic composition according to claim 11 wherein said silver salt is a salt of a long chain fatty acid containing 8 to 30 carbon atoms.

13. A photothermographic composition according to claim 11 wherein said silver carboxylate is silver behenate.

14. A photothermographic composition according to claim 9 wherein said surface modifier is a mixture of mono- and di-esters of orthophosphoric acid and hydroxyl-terminated, oxyethylated long-chain alcohols or oxyethylated alkyl phenols.

15. A photothermographic composition according to claim 9 wherein said surface modifier is represented by the general structure:

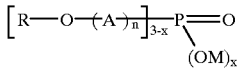

where x=1 or 2;

where R is either an alkyl group, straight chain or branched chain, with between 8 and 16 carbon atoms, or an alkyl phenyl group with between 12 and 16 carbon atoms, the alkyl group being in the para position relative to the oxygen atom, O; A is an ethylene oxide group (—$CH_2CH_2O$—), or a propylene oxide group, or a mixture of both groups; n has average values of between 3 and 12; and M is either hydrogen or an alkali metal cation.

16. A photothermographic element comprising a support having thereon an aqueous photothermographic composition comprising a) a photosensitive silver halide emulsion containing a peptizer and b) an oxidation-reduction imaging forming composition comprising (i) a nanoparticulate dispersion of silver carboxylate particles having on the surface of the particles a surface modifier which is a phosphoric acid ester and (ii) an organic reducing agent.

17. An photothermographic element according to claim 16 wherein said dispersion also contains about 1–20% by weight of carboxylic acid by weight of silver carboxylate.

18. A photothermographic element according to claim 16 wherein said silver carboxylate is a silver salt of a long chain fatty acid.

19. A photothermographic element according to claim 18 said silver salt is a salt of a long chain fatty acid containing 8 to 30 carbon atoms.

20. A photothermographic element according to claim 18 wherein said silver carboxylate is silver behenate.

21. A photothermographic element according to claim 16 said surface modifier is a mixture of mono- and di-esters of orthophosphoric acid and hydroxyl-terminated, oxyethylated long-chain alcohols or oxyethylated alkyl phenols.

22. A photothermographic element according to claim 16 said surface modifier is represented by the general structure:

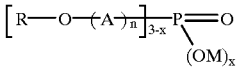

where x=1 or 2;

where R is either an alkyl group, straight chain or branched chain, with between 8 and 16 carbon atoms, or an alkyl phenyl group with between 12 and 16 carbon atoms, the alkyl group being in the para position relative to the oxygen atom, O; A is an ethylene oxide group (—$CH_2CH_2O$—), or a propylene oxide group, or a mixture of both groups; n has average values of between 3 and 12; and M is either hydrogen or an alkali metal cation.

23. A photothermographic element according to claim 16 further comprising a protective layer.

24. A controlled precipitation method of making nanoparticulate silver carboxylate particles having on the surface of the particles a surface modifier which is a phosphoric acid ester, said method comprising the steps of:

e) introducing said surface modifier, water and carboxylic acid into a vessel;

f) solubilizing said carboxylic acid by introducing a basic salt;

g) introducing a water soluble silver salt so as to precipitate said silver carboxylate particles;

h) recovering said particles.

* * * * *